US005566600A

United States Patent [19]

Johnson et al.

[11] Patent Number: 5,566,600

[45] Date of Patent: Oct. 22, 1996

[54] CONVEYOR/CLASSIFIER SYSTEM FOR VERSATILE HI-SPEED FOOD LOAF SLICING MACHINE

[75] Inventors: Arthur A. Johnson, Mokena; Scott A. Lindee, New Lenox; Glenn A. Sandberg, Lockport, all of Ill.

[73] Assignee: Formax, Inc., Mokena, Ill.

[21] Appl. No.: 320,749

[22] Filed: Oct. 11, 1994

[51] Int. Cl.[6] ..... B26D 7/30

[52] U.S. Cl. ..... 83/77; 83/91; 83/110; 83/155; 83/932

[58] Field of Search ..... 83/110, 77, 932, 83/91, 92, 92.1, 155

[56] References Cited

U.S. PATENT DOCUMENTS

| | | | |
|---|---|---|---|
| 2,227,683 | 1/1941 | Walter | 83/110 |
| 3,318,351 | 5/1967 | Werder | 83/92 |
| 3,821,913 | 7/1974 | Bajcar et al. . | |
| 3,842,698 | 10/1974 | Fitch et al. | 83/91 |
| 3,910,141 | 10/1975 | Divan . | |
| 3,965,457 | 6/1976 | Muller et al. . | |
| 4,196,646 | 4/1980 | Mukumoto . | |
| 4,405,186 | 9/1983 | Sandberg et al. . | |
| 4,545,447 | 10/1985 | Spooner et al. . | |
| 4,580,475 | 4/1986 | Antonissen . | |
| 4,598,618 | 7/1986 | Kuchler . | |
| 4,794,996 | 1/1989 | Wallace et al. | 83/77 |
| 5,033,341 | 7/1991 | Mussig et al. | 83/18 |
| 5,079,982 | 1/1992 | Antonissen . | |
| 5,101,702 | 4/1992 | Kuchler | 83/23 |
| 5,105,698 | 4/1992 | Dunham | 83/155 |

*Primary Examiner*—Kenneth E. Peterson
*Attorney, Agent, or Firm*—Dorn, McEachran, Jambor & Keating

[57] ABSTRACT

A versatile high speed slicing machine moves first and second food loaves along parallel loaf paths into a slicing station where both loaves are sliced by a cyclically driven knife blade. There are independent loaf feed drives so that slices cut from one loaf may be thicker than slices from the other. The conveyor/transfer system onto which food loaves are deposited as cut includes a receiver located below the slicing station; a lift mechanism moves the receiver down during slicing so that slices always fall about the same distance after being cut. The receiver includes a horizontal conveyor that periodically discharges groups of food loaf slices onto a deceleration conveyor, from which the groups are fed onto a multi-belt scale conveyor. The scale conveyor is aligned with two receiver grids, each grid including plural grid elements interleaved one-for-one with the scale conveyor belts. In each machine cycle a group of food loaf slices is deposited on a grid and weighed. Two slice groups are usually weighed individually and simultaneously. The group weights control two classifier transfer conveyors.

9 Claims, 8 Drawing Sheets

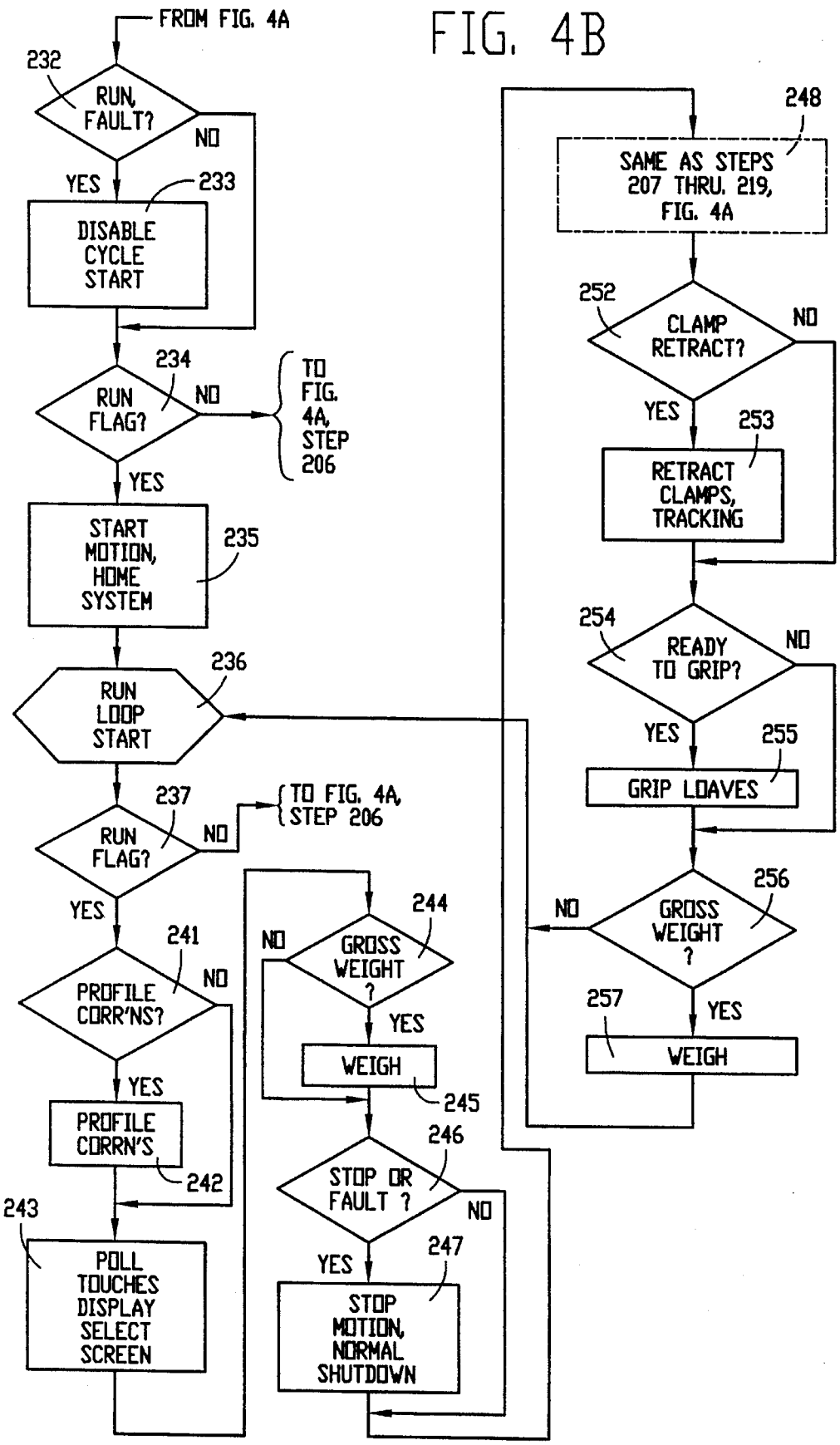
FIG. 4B
FROM FIG. 4A
232
RUN, FAULT?
NO
YES
233
DISABLE CYCLE START
234
RUN FLAG?
NO
TO FIG. 4A, STEP 206
YES
START MOTION, HOME SYSTEM
235
236
RUN LOOP START
237
RUN FLAG?
NO
TO FIG. 4A, STEP 206
YES
241
PROFILE CORR'NS?
NO
YES
PROFILE CORRN'S
242
243
POLL TOUCHES DISPLAY SELECT SCREEN
244
NO
GROSS WEIGHT ?
YES
WEIGH
245
246
STOP OR FAULT ?
NO
YES
247
STOP MOTION, NORMAL SHUTDOWN
248
SAME AS STEPS 207 THRU. 219, FIG. 4A
252
CLAMP RETRACT?
NO
YES
253
RETRACT CLAMPS, TRACKING
254
READY TO GRIP?
NO
YES
255
GRIP LOAVES
256
NO
GROSS WEIGHT ?
YES
257
WEIGH

CONVEYOR/CLASSIFIER SYSTEM FOR VERSATILE HI-SPEED FOOD LOAF SLICING MACHINE

BACKGROUND OF THE INVENTION

Many different kinds of food loaves are produced; they come in a wide variety of shapes and sizes. There are meat loaves made from various different meats, including ham, pork, beef, lamb, turkey, fish, and even meats not usually mentioned. The meat in the food loaf may be in large pieces or may be thoroughly comminuted. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Many of these food loaves meet a common fate; they are sliced, the slices are grouped in accordance with a particular weight requirement, and the groups of slices are packaged and sold at retail. The number of slices in a group may vary, depending on the size and consistency of the food loaf and even on the whim of the producer, the wholesaler, or the retailer. For some products, neatly aligned stacked slice groups are preferred. For others, the groups should be shingled so that a purchaser can see a part of every slice through a transparent package. And when it comes to bacon or other food products of variable shape, the problems do not just increase; they literally multiply.

A variety of different known slicing machines have been used to slice food loaves. They range from small, manually fed slicers used in butcher shops and in retail establishments to large, high speed slicers usually employed in meat processing plants. The present invention is directed to a high speed slicing machine used in a meat processing plant.

Some known high speed food loaf slicing machines have provided for slicing two food loaves simultaneously with a single, cyclically driven knife blade. Other prior high speed slicing machines, including that shown in S. Lindee et al. U.S. Pat. No. 4,428,263, have sliced one loaf at a time. They could be expanded to slice two or more loaves simultaneously. But none of the prior high speed slicing machines have had the versatility needed to slice food loaves of the many different sizes and shapes referred to above, particularly with provision for either stacking or shingling of the sliced output, variations in slice thickness and slice count from two different loaves, and precision control of the weights of slice groups.

SUMMARY OF THE INVENTION

It is a principal object of the present invention to provide a new and improved conveyor/transfer system for the output of a versatile high speed food loaf slicing machine capable of slicing one, two, or more food loaves with a single cyclically driven knife, a conveyor/classifier system that can provide stacked slice groups or shingled slice groups and that weighs and classifies all food loaf slice groups in the slicing machine.

Another object of the invention is to provide a new and improved conveyor/classifier system for the output of a versatile high speed food loaf slicing machine that can weigh food loaf slice groups, as cut, at any speed within a broad speed range, regardless of whether the slice groups are stacked or shingled.

A further object of the invention is to provide a new and improved conveyor/classifier system for a versatile high speed food loaf slicing machine incorporating self-correcting precision weight control, preferably with internal computer control, so that the slicing machine output is adapted to a broad range of end use requirements.

These and other objects of the invention are realizable with the present invention as described more fully hereinafter.

Accordingly, the invention relates to an improved high speed food loaf slicing machine comprising a slicing station including a knife blade and a knife blade drive cyclically driving the knife blade along a predetermined cutting path, and loaf support means supporting a first food loaf and a second food loaf for movement along first and second loaf paths, respectively, into the slicing station for repetitive slicing of both loaves by the knife blade. The improvement comprises a receiver, including a receiver conveyor having a plurality of spaced receiver conveyor belts, located below the slicing station for receiving food loaf slices cut from the first and second food loaves to form a first food loaf slice group and a second food loaf slice group. A receiver lift mechanism is connected to the receiver for moving the receiver vertically toward and away from the slicing station. A receiver conveyor drive drives the receiver conveyor horizontally at a predetermined discharge speed to discharge food loaf slice groups from the receiver. A deceleration conveyor receives food loaf slice groups from the receiver, and a deceleration conveyor drive drives the deceleration conveyor at a predetermined speed lower than the discharge speed.

BRIEF DESCRIPTION OF THE DRAWINGS

In the Drawings:

FIGS. 4A and 4B jointly comprise a flow chart for a computer control used in the slicing machine of FIGS. 1–3;

DESCRIPTION OF THE PREFERRED EMBODIMENTS

A. The Basic Slicing Machine, FIGS. 1–3.

Figure 1:
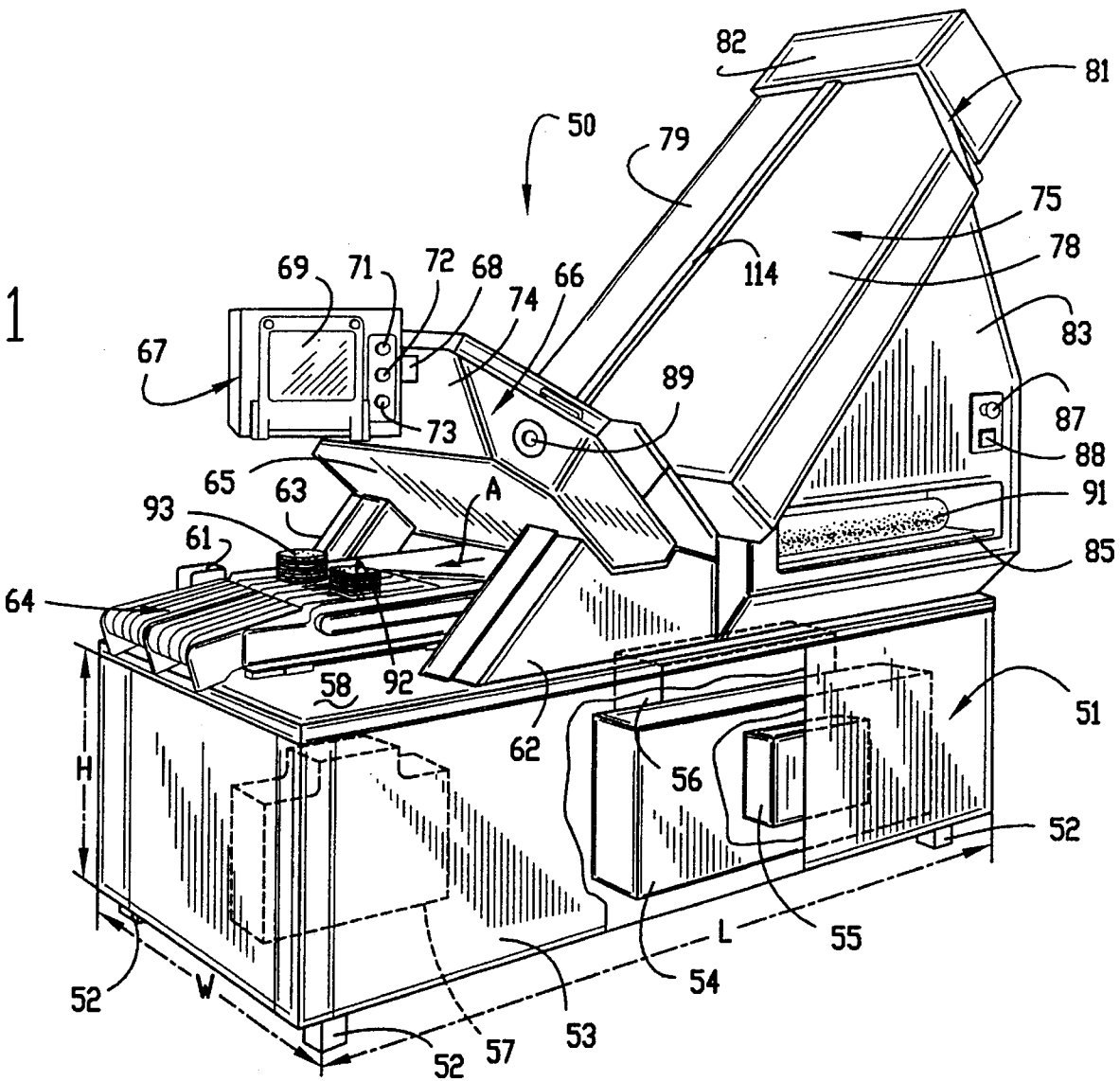
FIG. 1 is a perspective view of a slicing machine comprising a preferred embodiment of the invention, with portions of the covers on the machine base cut away to show typical power supply and computer enclosures.

FIG. 1 illustrates a versatile, hi-speed food loaf slicing machine 50 that includes a conveyor/classifier system constructed in accordance with a preferred embodiment of the present invention. Slicing machine 50 comprises a base 51 which, in a typical machine, may have an overall height H of approximately 32 inches (81 cm), an overall length L of about 103 inches (262 cm), and a width W of approximately 41 inches (104 cm). Base 51 is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also include a pneumatic supply or a hydraulic supply, or both (not shown).

Slicing machine 50, as seen in FIG. 1, includes a conveyor drive 61 utilized to drive an output conveyor/classifier system 64 that is constructed in accordance with a preferred embodiment of the present invention. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45° and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing head 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71–73 and display/touch screen 69 are electrically connected to computer 54 in base 51.

The upper right-hand portion of slicing machine 50, as seen in FIG. 1, comprises a loaf feed mechanism 75 which, in machine 50, includes a manual feed on the far side of the machine and an automated feed on the near side of the machine. Loaf feed mechanism 75 has an enclosure that includes a far-side manual loaf loading door 79 and a near-side automatic loaf loading door 78. Slicing machine 50 is equipped for automated loading of loaves from the near side, as seen in FIG. 1, and manual loading of food loaves on the far side of the machine. Automated loaf loading could be provided on either or both sides of the machine; the same holds true for manual loaf loading.

Slicing machine 50, as shown in FIG. 1, further includes a pivotable upper back frame 81 and a housing 82. A loaf feed guard 83 protects the near-side of the loaf feed mechanism 75. Behind loaf feed guard 83 there is a loaf lift tray 85 employed for automated loading of a food loaf into machine 50. Tray 85 preferably has a textured upper surface. A fixed loaf storage tray, used for manual loaf loading, is located on the opposite side of machine 50 but is not visible in FIG. 1.

There are some additional switches seen in FIG. 1. An emergency stop switch 87 for interrupting all operations of slicing machine 50 is mounted on the near-side of loaf feed guard 83. There may be a similar emergency stop switch on the opposite side of the machine. A loaf lift switch 88 for initiating automated loading of a loaf from tray 85 into mechanism 75 is located immediately below switch 87. An emergency stop switch 89 is mounted on slicing station 66 on the near-side of machine 50, and there is a similar switch (not shown) on the opposite side of the slicing station. Switches 87, 88, and 89, and any counterparts on the opposite (far) side of slicing machine 50, are all electrically connected to the low voltage controls in enclosure 55.

As shown in FIG. 1, slicing machine 50 is ready for operation. There is a food loaf 91 on tray 85, waiting to be loaded into loaf feed mechanism 75 on the near side of machine 50. Two or even three food loaves may be stored on tray 85, depending on the loaf size. A similar food loaf or loaves may be stored on a corresponding storage tray on the opposite side of machine 50. Machine 50 produces a series of stacks 92 of food loaf slices that are fed outwardly of the machine, in the direction of the arrow A, by the conveyor/classifier system 64 of the present invention. Machine 50 also produces a series of stacks 93 of food loaf slices that also move outwardly of the machine on its output conveyor system 64 in the direction of arrow A. Usually, both of the slice stacks 92 and 93 either round or rectangular, but slicing station 66 can slice a round loaf and a rectangular loaf simultaneously. Stacks 92 and 93 may have different heights, or slice counts, and hence different weights; as shown they contain the same number of food loaf slices in each stack. Both groups of slices can be overlapping, "shingled" groups of slices instead of having the illustrated stacked configuration, based on the operation of system 64, as described more fully hereinafter. Groups 92 and 93 are always alike in one respect; both are stacks or shingle groups. Three or more loaves can be sliced simultaneously; slicing of two loaves is more common.

Figure 2:
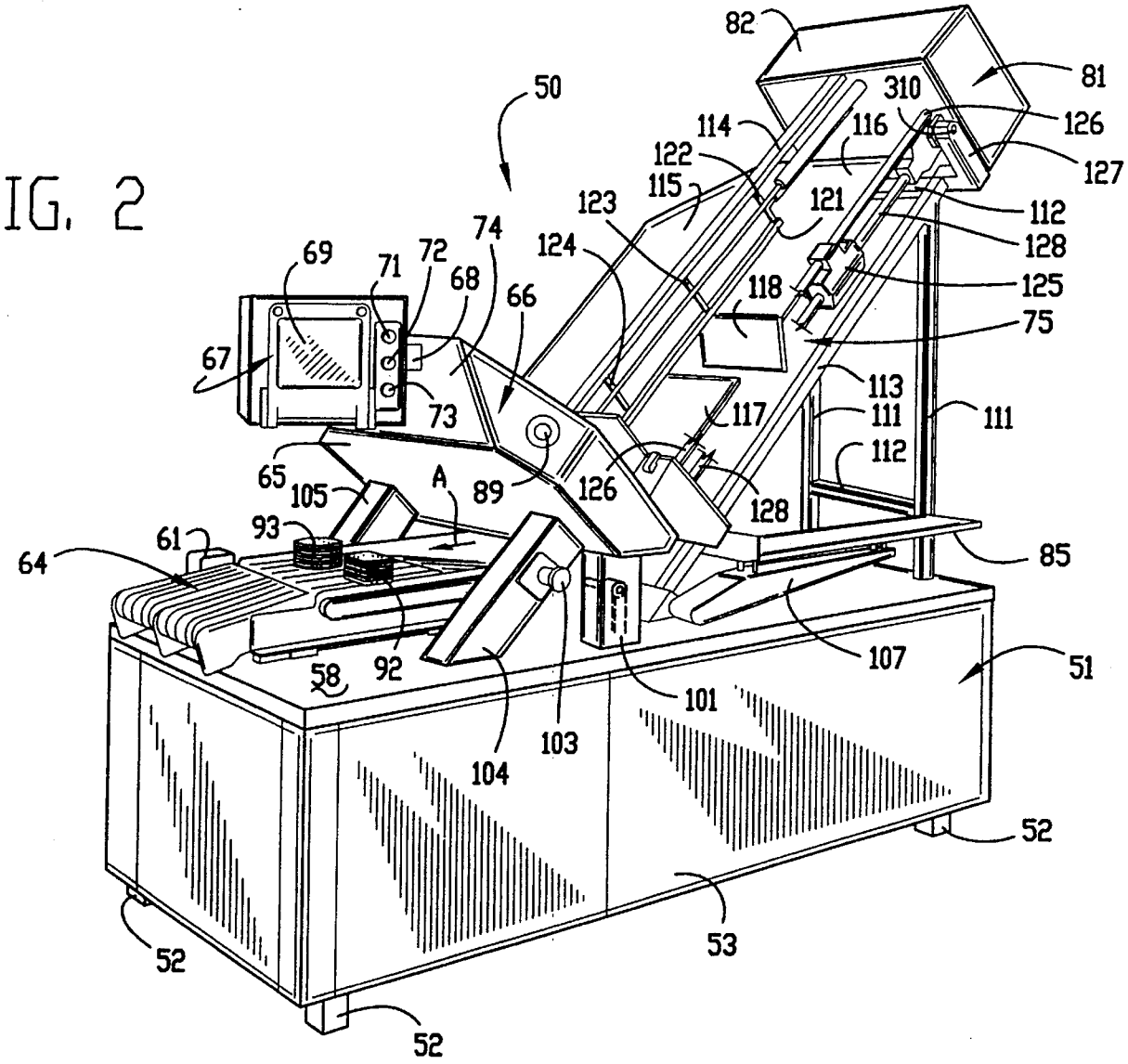
FIG. 2 is a perspective view, like FIG. 1, with some guards and covers removed and some operating components shown in simplified form.

FIG. 2 illustrates the slicing machine 50 of FIG. 1 with a number of the covers omitted to reveal additional operating components. As shown in FIG. 2, there is a stack/shingle receiver conveyor drive 101 located on the near side of slicing machine 50. One part of the drive for slicing station 66 is enclosed within a support enclosure 104 on the near side of machine 50. A manual slicing station rotation knob 103 is mounted on and projects into enclosure 104 for mechanical connection to the slicing station drive. At the opposite side of slicing machine 50 there is an enclosure 105 for a knife drive. Slicing station drive enclosure 104 and knife drive enclosure 105 extend upwardly from table top 58 at an angle, preferably approximately 45°, corresponding to the angular alignment of mechanism 75. There is a manual knife rotation knob (not shown) on the far-side of machine 50, corresponding to knob 103.

A loaf tray pivot mechanism 107 is located above top 58 of base 51 on the near side of slicing machine 50. Mechanism 107 is connected to and operates the automatic loaf lift tray 85.

Slicing machine 50 includes a fixed frame pivotally supporting the automated feed mechanism 75 for feeding food loaves into slicing head 66. In the construction shown in FIG. 2, this fixed frame includes a pair of vertical frame members 111 affixed to base 51 and interconnected by two horizontal frame members 112 and joined to two angle frame members 113 (only one shows in FIG. 2). Frame members 111–113 are all located above the top 58 of machine base 51. A frame member 114 extends from the upper back frame 81 downwardly, parallel to frame members 113, toward slicing head 66. The upper back frame 81 is mounted on pivot pins 310 between the upper ends of two fixed frame members 127; only one member 127 appears in FIG. 2. Preferably, all of the operating elements of the automated food loaf feed mechanism are mounted on the back frame and are pivotally movable (through a small angle) relative to the fixed frame 111–113. A manual feed tray 115 is shown at the far-side of slicing machine 50 as illustrated in FIG. 2.

At the top of slicing machine 50, as seen in FIG. 2, there is an upper loaf support tray 116 that has its upper surface aligned with the top surface of a lower loaf support tray 117. Supports 116 and 117 are preferably one piece, joined by side members omitted in FIG. 2 to avoid overcrowding. The gap between loaf supports 116 and 117 is normally filled by a loaf end discharge door 118; thus, members 116–118 normally afford a continuous loaf support surface that is the bottom for the two loaf paths in slicing machine 50. In FIG. 2, however, door 118 is shown in its open discharge position. Door 118 is hinged at the lower edge of loaf support 116 and can be elevated to provide a direct, uninterrupted surface for support of a loaf throughout mechanism 75 during most of the slicing operations carried out by machine 50. A textured upper surface is preferred for support members 116–118 to improve sliding movement of a food loaf along those support members toward slicing station 66.

The loaf feed mechanism 75 of slicing machine 50, FIG. 2, further includes a central barrier or divider 121. Barrier 121, which is used to align two food loaves on supports 116–118, is suspended from frame member 114 by a plurality of pivotal supports 122, 123 and 124. During operation of slicing machine 50 divider 121 is elevated from the position shown in FIG. 2 to permit loading of one or more food loaves onto the supports 116–118. Barrier 121 is also elevated during loaf slicing so that it will not interfere with other components of mechanism 75.

The part of food loaf feed mechanism 75 shown in FIG. 2 also includes a carriage 125 that is mounted upon an elongated rotatable shaft 126 and a stationary shaft 128; shafts 126 and 128 are both parallel to the loaf support 116–118. Carriage 125 moves along shafts 126 and 128, on a path approximately parallel to support members 113. There is a like carriage, carriage shafts, and carriage drive on the far side of slicing machine 50.

Figure 3:
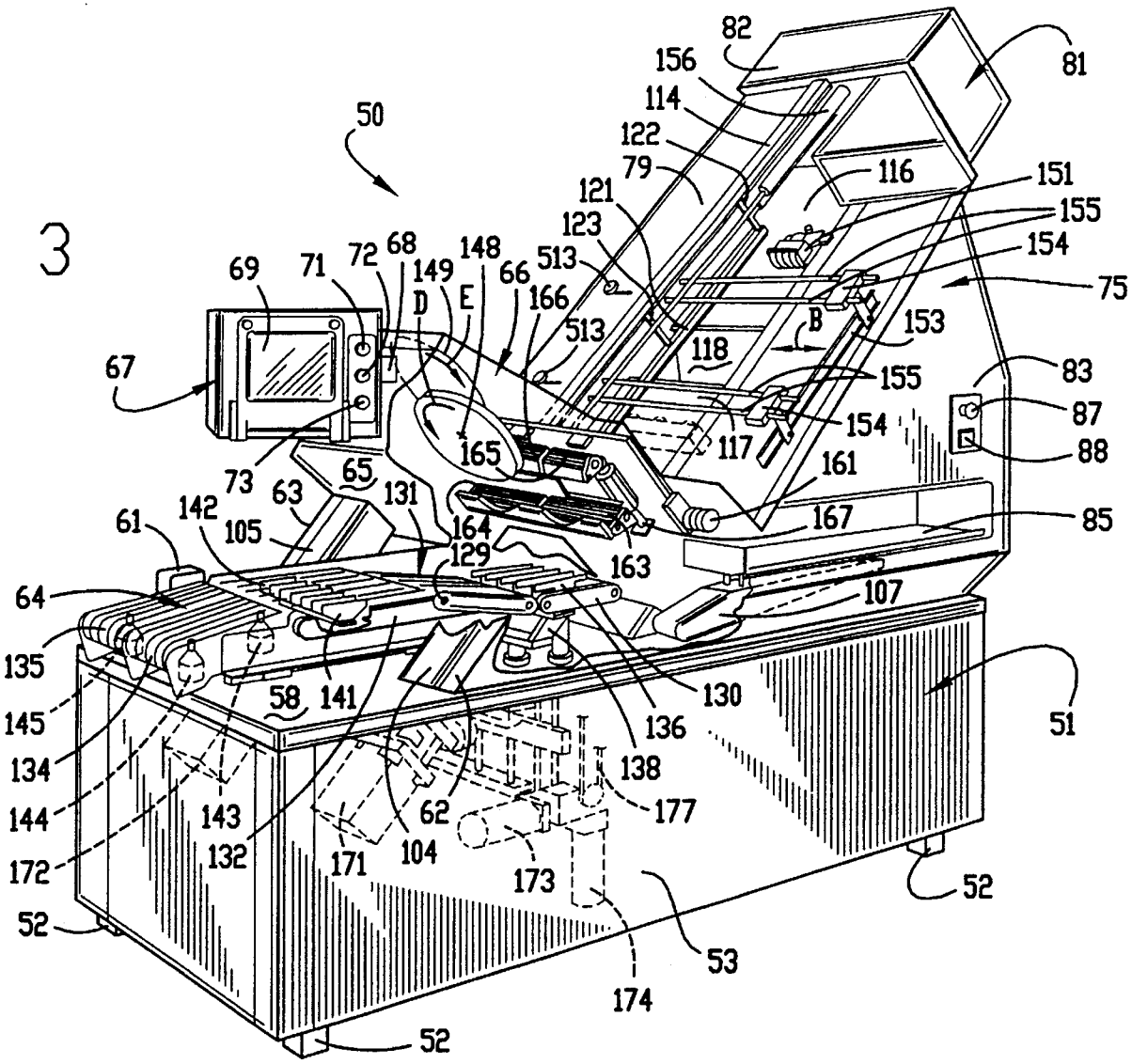
FIG. 3 is a perspective view, like FIGS. 1 and 2, with other guards and covers cut away to show further operating components of the slicing machine, some illustrated in simplified form.

FIG. 3 illustrates the same slicing machine 50 that is shown in FIGS. 1 and 2 in a conceptual view showing additional components and parts of the slicing machine. Thus, FIG. 3 illustrates the general arrangement of operating components within one construction usable for slicing head 66, one preferred construction that may be used for conveyor/classifier system 64, and the drive motors for parts of slicing machine 50.

Referring first to the conveyor/classifier system 64 at the left-hand (output) end of slicing machine 50, in FIG. 3, it is seen that system 64 includes an inner receiving conveyor 130 located immediately below slicing head 66; conveyor 130 is sometimes called a "jump" conveyor in some versions of machine 50. From conveyor 130 groups of food loaf slices, stacked or shingled, are transferred to a decelerating conveyor 131 and then to a weighing or scale conveyor 132. From the scale conveyor 132 groups of food loaf slices move on to an output classifier or transfer conveyor 134. On the far side of slicing machine 50 the sequence is the same, but that side of system 64 ends with a second transfer conveyor 135 located next to conveyor 134.

Slicing machine 50, FIG. 3, may further include a vertically movable receiver grid 136 comprising a plurality of grid members Joined together and interleaved one-for-one with the moving belts of the receiver conveyor 130. Grid 136 can be lowered and raised by a receiver lift mechanism 138, as shown in FIG. 3. Alternatively, food loaf slices may be grouped, in shingled or in stacked relationship, directly on the belts of the receiver conveyor 130, with a series of stacking pins 137, on pinwheels, replacing grid 136 (see FIG. 7). When this alternative is employed, lift mechanism 138 is preferably connected directly to and is used for vertical positioning of receiver conveyor 130.

Slicing machine 50 further comprises a scale or weighing grid comprising a first plurality of scale grid elements 141 and a second similar group of scale grid elements 142; each group of grid elements is interleaved one-for-one with half of the moving belts or like members of scale conveyor 132. Scale grids 141 and 142 are a part of scale mechanism 57 (see FIG. 1). A scale conveyor lift mechanism 143 is mechanically connected to scale conveyor 132. There is a transfer conveyor lift mechanism 144 connected to the near-side classifier conveyor 134. A similar lift device 145 is provided for the other output transfer conveyor 135. Lift devices 144 and 145 are employed to pivot conveyors 134 and 135, respectively, from their illustrated "accept" positions to elevated "reject" positions, depending on the results of the weighing operations in machine 50 ahead of conveyors 134 and 135. See also FIG. 7.

In the construction shown in FIG. 3, slicing station 66 includes a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion and also rotates. Other slicing head constructions may be used in machine 50, so long as the cutting edge of knife blade 149 moves along a predetermined cutting path to cut a slice from each of one, two, or more food loaves in each cycle of operation.

As shown in FIG. 3, loaf feed mechanism 75 includes a near-side clamp or gripper mechanism 151. There is a similar gripper mechanism (not shown) at the far side of slicing machine 50. Gripper 151 is connected to and driven by carriage 125, FIG. 2. A near-side sweep member 153 is suspended from two sweep carriages 154 which in turn are each mounted upon a pair of sweep support rods 155. A somewhat different manual loaf guide is used in the far side of machine 50. Sweep carriages 154 are driven along rods 155 by belts, not shown in FIG. 3, as indicated by arrows B. Rods 155 are connected to a rotatable sweep actuator 156 for actuation thereby.

Slicing machine 50 is intended to accommodate food loaves of widely varying sizes; it can even be used as a bacon slicer. This makes it necessary to afford a height adjustment for the food loaves as they move from loaf feed mechanism 75 into slicing head 66. In FIG. 3, this height adjustment is generally indicated at 161.

Slicing machine 50 further comprises a system of short conveyors for advancing food loaves from loaf feed mechanism 75 into slicing head 66. FIG. 3 shows two short lower loaf feed conveyors 163 and 164 on the near and far sides of slicing machine 50, respectively. These short lower conveyors 163 and 164 are located immediately below two short upper feed conveyors 165 and 166, respectively. As used in describing conveyors 163–166, the term "short" refers to the length of the conveyors parallel to the food loaf paths along support 116–118, not to the conveyor lengths transverse to those paths. The upper conveyor 165 of the pair 163 and 165 is displaceable so that the spacing between conveyors 163 and 165 can be varied to accommodate food loaves of varying height. This adjustment is provided by a conveyor actuator 167 that urges conveyor 165 downwardly; conveyor 165 can be lifted manually when machine 50 is not in operation. A similar conveyor actuator is located on the far-side of machine 50 to adjust the height of the other upper short conveyor 166; the second actuator cannot be seen in FIG. 3.

Some of the drive motors for the operating mechanisms in slicing machine 50 are shown in FIG. 3. The drive motor for rotating the head or spindle 148 in slicing station 66 is a variable speed servo motor 171 mounted in the machine base 51. A similar servo motor 172 drives the knife blade 149. The receiver lift 138 is driven by a receiver lift motor 173, again preferably a variable speed servo motor. On the near side of machine 50 the loaf feed drive mechanism comprising gripper 151 and the short loaf feed conveyors 163 and 165 is driven by a servo motor 174. A like motor 175 on the far side of machine 50 (not shown in FIG. 3) affords an independent drive for the gripper and the "short" loaf feed conveyors 164 and 166 on that side of the slicing machine.

B. The Computer Flow Chart, FIGS. 4A and 4B.

Figure 4A:
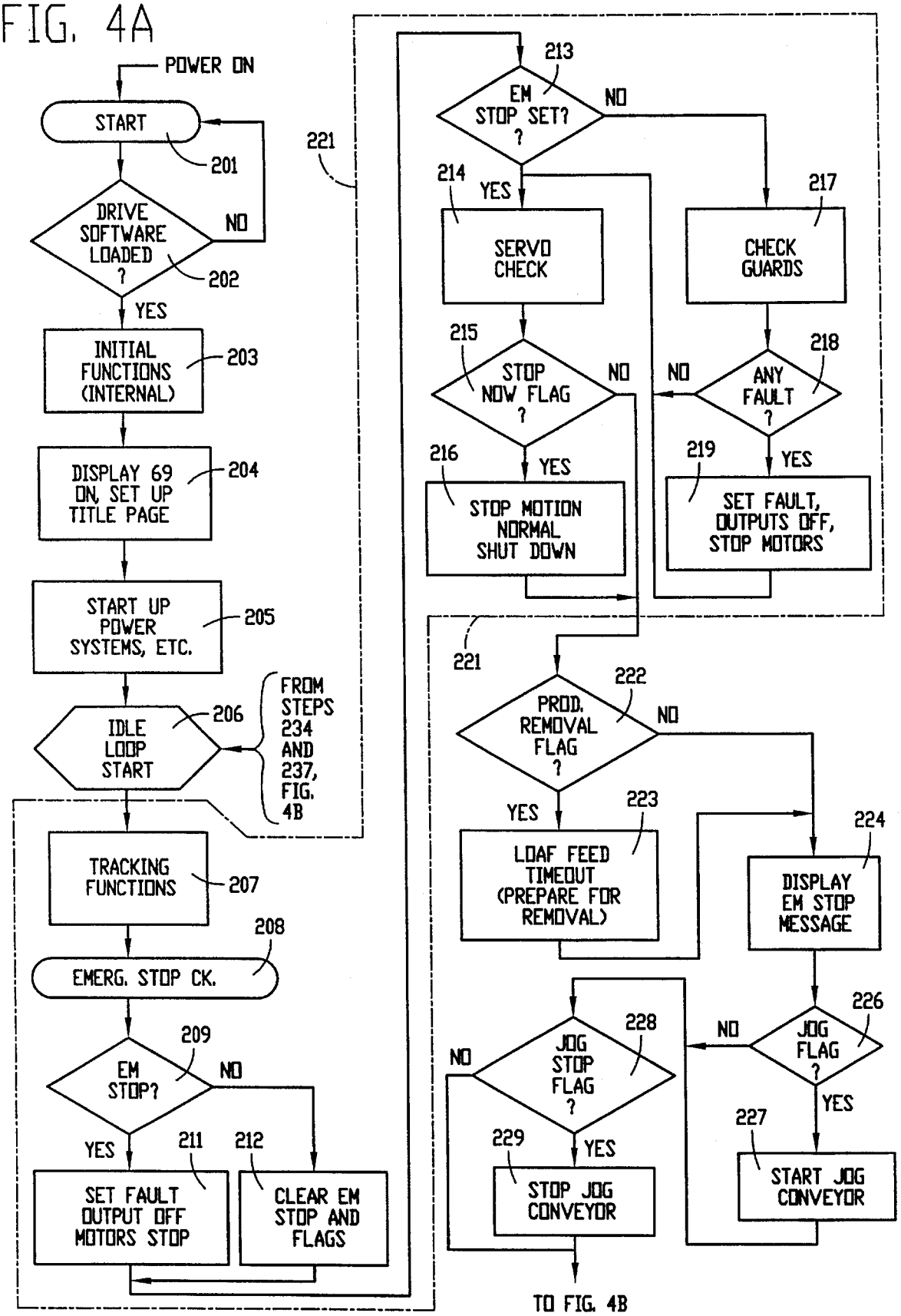

Slicing machine 50 (FIGS. 1–3) is fully computer controlled. Accordingly, basic operation can be described in conjunction with a flow chart indicative of the control functions carried out by the computer program. FIGS. 4A and 4B afford the requisite flow chart; FIG. 4B follows FIG. 4A. The basic preferred driver software is TOUCH BASE driver software, licensed by Touch Base, Ltd. through Computer Dynamics of Greer, S.C.; this driver software package allows operation of the touch screen functions used in slicing machine 50. If this driver software does not load on start up there is a serious problem with computer control.

At the outset, when slicing machine 50 is first placed in operation, power to the machine is turned on, as by actuation of an appropriate input power supply switch. This input power switch is not shown in the drawings; the power supply switch may be located in or on base 51 of machine 50. Calibration of the touch screen may be required on start up; if so the operator of the slicing machine initiates calibration by actuating switches 72 and 73 (FIGS. 1–3) simultaneously. If no calibration is needed, the first step in computer control of machine 50, in the initial part of the flow chart (FIG. 4A), is an initial start 201, also effected by the machine operator. This may be accomplished with the power supply switch referred to above, or an additional switch may be interposed in the circuit to energize computer 54 through the low voltage power supply 55 and the display/touch screen 69 (FIG. 1). In the next step 202 of the flow chart, a check is made to determine if the driver software is loaded; if not, a warning reset is supplied to step 201.

Once the driver software is loaded for step 202, and screen 69 has been energized, the program recorded in computer 54 (FIG. 1) performs a sequence of initial functions, indicated by step 203 in FIG. 4A. These initial functions may include initializing interrupt of vectors, graphics driver, determination of spindle tracking hours, establishment of product codes for defaults, and a check of a battery energized backup record memory (RAM). The computer program also sets the appropriate code to match the product to be sliced by the machine, selects several action boards previously set up in the computer, makes a determination of motion control interrupt functions, establishes raw data for scale arrays related to the food loaf products and the slicing operation, and selects previously recorded graphics pertaining to a wide variety of different products so that the graphics subsequently displayed on screen 69 match the product being processed. In addition, the computer program, in the course of the initial functions step 203 (FIG. 4A), sets the maximum knife speed ratio relative to the speed of slicing head 66 required for the desired slicing operation. For any of these initial functions, some input from the machine operator may be necessary; most inputs are effected by operator touch on screen 69 (FIGS. 1–3).

At this juncture, the touch/display screen 69 has been energized; the computer program for machine 50, in step 204, FIG. 4A, sets up a title page on the screen pertaining to the slicing and grouping operation or operations to be performed by machine 50. At the same time, or immediately thereafter, the computer program operates (step 205) to start up various power systems in machine 50. These functions may include initialization of an air pressure system or a hydraulic pressure system in machine 50, or both, depending on the requirements of operating components in the machine. Pneumatic actuation is usually preferred. A motor control power circuit, included in the high voltage power supply 56 (FIG. 1), is energized so that electrical motors (mostly A.C. servos) used to perform various functions in machine 50 have power available. In step 205 the computer program also determines appropriate sample periods for weighing operations and a seam correction for the scales actuated by weighing grids 141 and 142; the sample periods may be the same if machine 50 is to produce just one product from two or more separate loaves. In step 205 the computer program also determines the average slice thickness required for each product from machine 50. Again, the slice thicknesses (and the loaf and knife speeds that determine those thicknesses) may be the same, or they may be different for loaves sliced on the near and far sides of machine 50.

Once the computer program has completed the initializing functions of step 205, FIG. 4A, it starts an idle loop operation as indicated in step 206. This idle loop start step can go forward only if there are appropriate inputs from two flag determinations performed in steps 234 and 237 in FIG. 4B. When machine 50 has been idle, as is assumed, appropriate inputs are available from both of the two steps 234 and 237 in FIG. 4B.

At the beginning of the idle loop operation, step 206 in FIG. 4A, the program for slicing machine 50 tracks the running of calculation of a total time for the anticipated run of the slicing machine by reading start time and stop time and taking the difference; the computer also performs a plurality of other tracking functions, in step 207 (FIG. 4A). Thus, the computer records the total run time and also records the total time for power to be on, which may be somewhat longer. In step 207, the computer program may make a determination of the time period permissible before service of slicing machine 50 is required.

When these operations have been completed in step 207 the computer determines if an emergency stop check can be cleared in the next step 208. What this amounts to is a check to determine whether any of the emergency stop switches 87 and 89 have been actuated. If an emergency stop signal has been recorded, there is a "yes" output at step 209 in the program, resulting in initiation of a subsequent step 211. In step 211 the computer records a fault message, turns off all machine outputs, and stops all machine motors. If there is a "no" output at step 209, indicative of the fact that no emergency stop switch has been actuated, then a step 212 is carried out by the computer to clear any emergency stop message that may be held over from previous operations and to clear all flags from the control system.

In the next program step 213, FIG. 4A, the computer of slicing machine 50 makes a determination as to whether an emergency stop has been set. If this action has occurred, the next step 214 is the performance of a servo check by the computer and a determination of whether the drives for machine 50 are not ready for operation or if there has been a fault due to a thermal overload. In this step 214 the computer also may set a "stop now" flag. If such a flag is set, in the next step 215 the existence of that flag is identified and a further program step 216 is initiated to stop all motion in the slicing machine 50 and to carry out a normal shut down of that machine.

Returning to step 213, the computer may ascertain that no emergency stop has been set. In this circumstance, a step 217 is initiated to check whether all guards and doors have been closed on machine 50 and the motor drives for the slicing machine are ready for operation. In step 217 the computer also makes a determination of whether electrical faults have occurred as a result of vibration or other causes. If no fault is ascertained, an enabling output is produced in the next step 218 and fed back to the servo check of step 214. If a fault is found, the next program step 219 is initiated, setting a fault message, turning all outputs off, and stopping all motors in the slicing machine 50. The output from step 219 is supplied back to the servo check step 214. In FIG. 4A, it will be seen that steps 207–209 and 211–219 are all enclosed is a phantom outline 221, which is referred to again hereinafter in conjunction with a portion 248 of FIG. 4B.

The next step in the flow chart of FIG. 4A is a determination of whether a product removal flag has been set; see step 222. If such a flag has been set, a subsequent program step 223 is initiated. At this juncture, if the operator has held the load feed switch 73 (FIG. 1) actuated for a predetermined minimum period (typically five seconds) then the computer program prepares for product removal. Completion of step 223 or a determination in step 222 that no product removal flag has been set results in initiation of a further step 224, constituting a display of an emergency stop message on display screen 69 (FIG. 1).

Following step 224, in the next step 226 of FIG. 4B the recorded program of slicing machine 50 checks to determine whether a flag has been set to preclude jogging of the conveyor system 64. If there is an affirmative output from step 226, a subsequent step 227 starts jogging movement of the conveyor system. An output from step 227 or a negative output from step 226 initiates a subsequent step 228, which is a check to determine whether a flag has been set for stopping jogging movement of the conveyor system. If no such flag has been set there is an output to the initial stage 232 of FIG. 4B. If there is an affirmative output from step 228, then an additional step 229 is carried out to stop jogging movement of the conveyor system 64 (FIG. 1).

FIG. 4B shows the steps for the remainder of the flow chart that began with FIG. 4A. At the beginning of the portion of the flow chart shown in FIG. 4B, there is a program step 232 in which the computer looks to see if there has been a start run and a fault set. If both conditions have occurred while attempting to start a run cycle, there is a yes output from step 232 to the next step 233 and a disabling cycle is initiated for slicing machine 50 by the program prerecorded in its computer. In the course of step 233, if there has been a run flag, so that running of the machine is not permissible, that flag may be cleared. 0f course, the stated combination of conditions (lack of a start run or a run fault set) may not be found in step 232, in which case step 233 is by-passed. In either event, there is an enabling input to a further step 234 in the computer program, which again checks for the existence of a run flag. Actually, in step 234 the program is checking to see whether the cycle start switch 73 has been actuated by the operator. If not, there is an output to step 206 in FIG. 4A. If the operator has actuated the run/start control switch, there is an enabling output to the next step 235 in the flow chart.

In step 235 of the flow chart, FIG. 4B, the computer performs a variety of functions. To begin with, it records the time that machine 50 has been out of operation for faults and starts a number of machine subsystems in operation. Thus, in display 69 the computer program causes the display of a homing message. The knife 149 in slicing head 66 (FIG. 3) is brought to a home orientation. The clamps 151 of loaf feed system 75 (see FIG. 3) are also brought to their respective home positions. Other homing operations are performed for the conveyors of conveyor system 64. The computer checks to see if the enclosure doors for loaf feed system 75 are closed, as shown in FIG. 1. Center divider 121 (FIGS. 2 and 3) is raised to its elevated position, high enough to be clear of any loaf that may be moved onto the loaf supports (116–118) of the slicing machine. Grippers 151 are unactuated; see FIG. 12. The controls of machine 50 are set for automatic or manual loading. The loaf cover is raised, stacking conveyor 130 is elevated, and motion control for the machine is checked to see whether it has been cleared. The anticipated production start time is also recorded in step 235. When all of these operations have been completed, an output to step 236 in the flow chart is effected; machine 50 is now ready to start slicing. It is assumed that there is an appropriate input to program step 236 from the final step of the flow chart, as described below.

In the next step 237 of the program illustrated by the flow chart of FIG. 4B, the computer of machine 50 ascertains whether a flag has been set to permit running operation. This is a requirement imposed upon the machine operator. If it has not been fulfilled, there is a no output from stage 237 to step 206 in the portion of the flow chart illustrated in FIG. 4A, so that machine 50 reverts to its idle mode of operation. However, if the operator has set a run flag to indicate that machine 50 is ready for slicing and that such operation is desired, then there is an output from program step 237 to the next step 241.

It may be desirable to check for profile variations at the beginning and end of each food loaf sliced, in order to track taper of the loaf and made thickness corrections according to loaf profile trends. If profile corrections are to be made, step 241 affords a YES output to the next step 242 to make profile corrections. If there are to be no profile corrections, or if none are required, the next input is to program step 243. At this point, the touch screen 69 is checked to see if the operator has entered instructions by means of a touch; the selected screen image is displayed. In the succeeding step 244 the computer checks to see if gross (product) weight is to be measured. If the answer is YES, a gross weight for the product is determined in step 245. When that weighing step is completed, or if no product weight is to be determined, the flow chart goes on to a further step 246. In the next step 246 the computer ascertains whether a stop switch has been actuated or a fault has been found by the sensor switches of machine 50, such as sensor switches that determine whether all guards are in place. If, in step 246, it is determined that operation of the slicing machine 50 should not begin, then in the next step 247 all motion within the machine is interrupted and a normal shutdown is carried out. Step 247 is by-passed if there is a negative condition ascertained in step 246. After step 247, the program represented by the flow chart performs functions, in a composite step 248, that correspond in all respects to the functions described above for steps 207–209 and 211–219 in phantom outline 221 of FIG. 5.

After the composite step 248, FIG. 4B, an input to the next step 252 in the flow chart may result in a determination that the gripper clamps 151 of machine 50 (FIG. 3) need to be retracted, or that they do not need to be retracted. If the clamps must be retracted, then program step 253 comes into play. The clamps are retracted, and the average load time and number of loaves are tracked. On the other hand, step 253 in the program may be by-passed by a negative output from step 252. In either case, there is an enabling input to program step 254, where it is ascertained whether the grippers 151 are ready to grip food loaves. If yes, the gripping operation of step 255 is initiated. If no, the next subsequent step 256 is enabled. Step 256 may also be enabled by an output from step 255. As the food loaf slice groups constituting the output of slicing machine 50 move to position to be weighed on conveyor 132, an appropriate input has been made, prior to this time, by the computer program. In step 256 of the program flow chart, a positive output results in an enabling signal to the next step 257, to cause the machine to weigh each product slice group as it leaves the machine. If the sliced product group (or groups) is not in position for weighing, there is a negative output from step 256, or an output from step 257, supplied to the run loop start step 236 to maintain the slicing machine in operation. Either way, operation continues until a given desired slicing operation is finished.

C. Loaf Load, Loaf Feed and Slicing Mechanisms—FIGS. 5 and 6.

Figure 5:
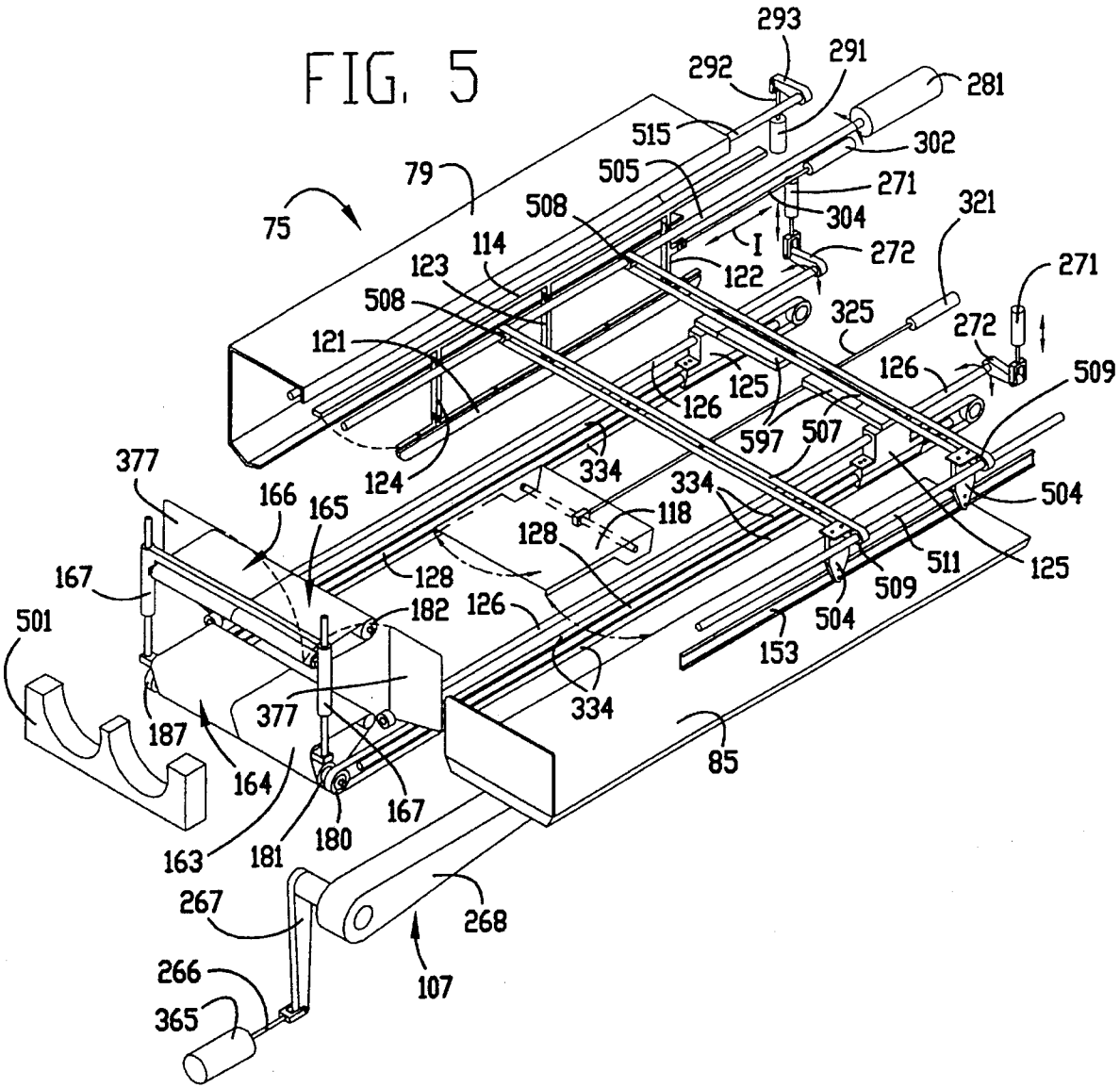
FIG. 5 is a schematic, simplified illustration of food loaf loading and feeding mechanisms for the slicing machine of FIG. 1–3.

FIG. 5 affords a simplified schematic illustration of most of the loaf loading and loaf feed mechanisms in slicing machine 50. Starting at the left-hand side of FIG. 5, it is seen that there is a loaf lift cylinder 365 having an actuating rod 266 connected to a crank 267 that in turn drives a loaf lift lever 268. These members 265–268 are a part of the loaf lift mechanism 107 that lifts storage tray 85 from its storage position (FIGS. 1–3) to a level even with the support 116–118 on which food loaves rest during slicing. The loaf lift mechanism is actuated only during loaf loading; during a loaf feeding/slicing operation, cylinder 365 does not need to be actuated and may keep tray 85 in its storage position.

FIG. 5 shows the "short" conveyors 163–166. The two upper "short" conveyors 165 and 166 are mounted on the housings of cylinders 167. Cylinders 167 have fixed shafts; air applied under pressure to the cylinders tends to drive their housings and conveyors 165 and 166 down toward the lower conveyors 163 and 164. Downward movement of the upper conveyors is blocked by a shear edge member 501 that is specific to the size of loaves being sliced, so that each pair of the conveyors engages opposite sides (top and bottom) of a food loaf being sliced. The drive spindles 181, 182, and 187 for conveyors 163, 165 and 164 also appear in FIG. 5.

Drive pulley 180, as shown in FIG. 5, is in meshing engagement with a near side timing belt 334 that extends the full length of the loaf feed mechanism 75. Belt 334 is connected to gripper carriage 125 on the near side of the slicing machine and is used to drive the carriage toward the slicing station and back again, in the direction of arrow J. There is a like gripper carriage 125 driven by another long timing belt 334 on the far side of the machine. Two parallel shafts 126 and 128 guide movements of each of the carriages 125. Shafts 128 are stationary but each of the shafts 126 can be rotated by means of a loaf door cylinder 271 and a connecting crank 272.

Returning to the left-hand side of FIG. 5, it is seen that there are two loaf doors 377, one on each side of feed mechanism 75, immediately to the right of conveyors 163–166. The near-side loaf door 337 is mounted on one shaft 126 so that it can be rotated to close off access of a food loaf into the space between conveyors 163 and 165. Similarly, the far-side loaf door 377 is mounted on the other shaft 126 and can be rotated to close off access of a food loaf into the space between conveyors 164 and 166.

FIG. 5 shows the central barrier or divider 121, which is suspended from the auxiliary frame member 114 by three pivotal hangers 122–124. The hanger 122 at the right-hand end of barrier 121, as seen in FIG. 5, is connected by a shaft 304 to an air cylinder or other linear actuator 302. Linear actuator 302 can be used to lift barrier 121, pivotally, to a point clear of any food loaves in the loaf feed mechanism.

On the near side of the slicing machine, in mechanism 75, there is an elongated sweep 153; see the lower right-hand portion of FIG. 5. Sweep 153 is suspended from two hangers/carriages 504, each connected to a drive belt 507. There are structural members, not shown in FIG. 5, that afford further support for the hanger-carriages 504; see FIG. 3. Belts 507 are timing belts, each engaging a drive pulley 508 and an idler pulley 509. Idlers 509 are mounted on a shaft 511. Drive pulleys 508 are both affixed to a shaft 505 rotated by a loaf sweep motor 281.

FIG. 5 shows the loaf feed door 118 in its normal elevated position, the position the door occupies when slicing is going forward. Door 118 is connected by a long rod 325 to a linear actuator 321 that opens the door to allow discharge of an unsliced butt end of a loaf from mechanism 75.

Some of the manual loaf loading components of mechanism 75 do not appear in FIG. 5; they are masked by the manual loaf door 79 which is mounted on a shaft 515. Shaft 515 is rotated by a manual door cylinder 291 connected to the shaft by its operating rod 292 and a crank 293.

Figure 6:
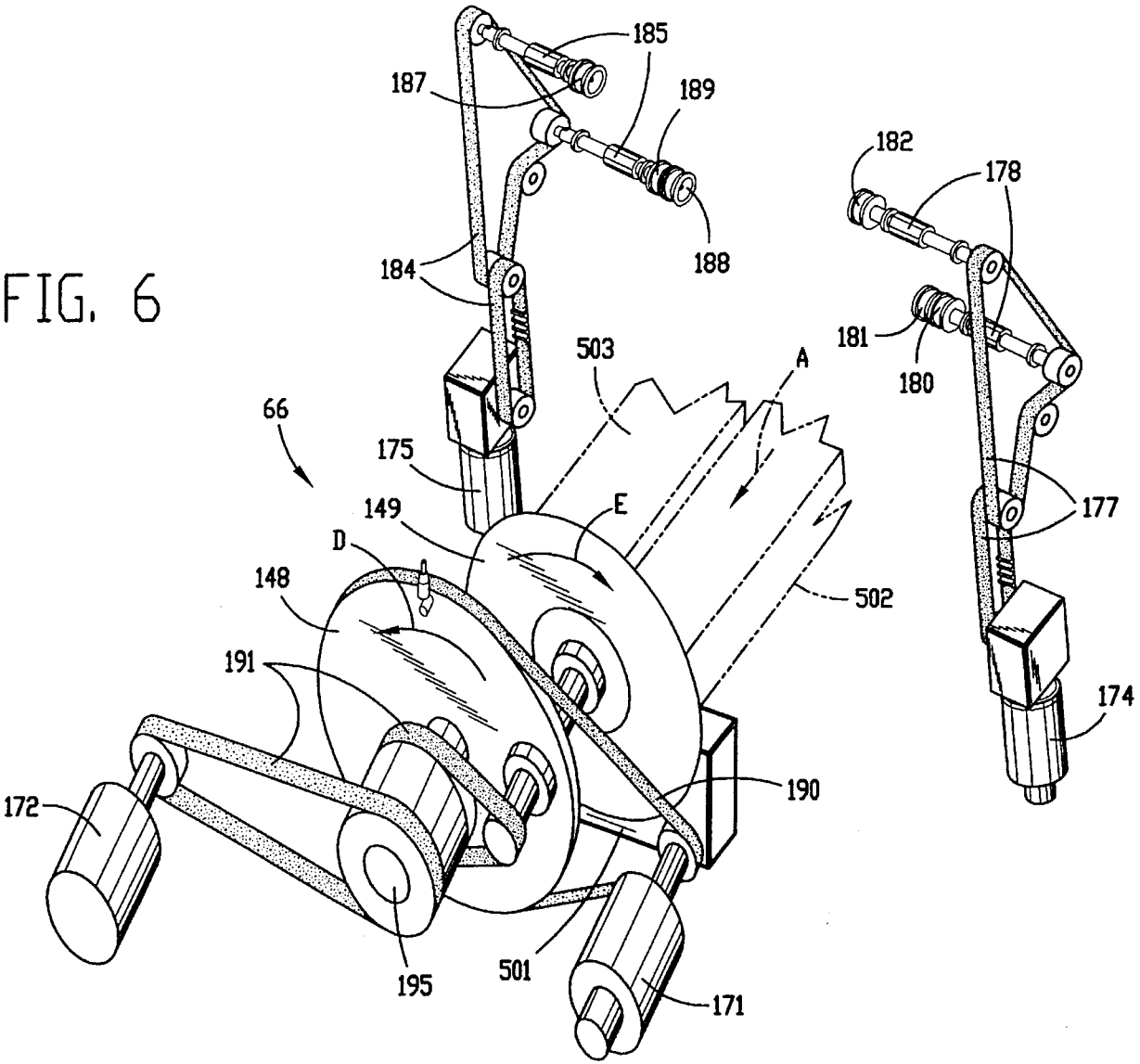
FIG. 6 is a schematic, simplified illustration of some of the drives in the slicing machine of FIGS. 1–3.

FIG. 6 affords an extended, simplified illustration of slicing station 66 and of some of the drives for the loaf feed mechanisms of FIG. 5. In the right-hand portion of FIG. 6 servo motor 174 is shown connected, as by a series of timing belts 177 and a pair of universal-joint drive connectors 178, in driving relation to the drive pulleys 181 and 182 for the "short" conveyors 163 and 165 on the near side of the slicing machine. Motor 174 also drives another belt drive pulley 180 that also appears in FIG. 5. Pulley 181 is the drive pulley for the near-side lower "short" loaf feed conveyor 163 (FIG. 3); pulley 182 is the drive pulley for the near-side upper "short" loaf feed conveyor 165 (FIG. 3). Pulley 180 is the drive pulley for gripper drive belt 334 that drives carriage 125 on the near side of the slicing machine; see FIG. 5. All of the loaf feed drive pulleys 180–182 have the same peripheral speed. Variation of the operating speed of servo motor 174 serves to vary the speed at which one food loaf, loaf 502, is advanced into slicing station 66.

On the far side of the slicing machine, and as shown in FIG. 6, there is another servo motor 175 that, through a series of belts 184 and a pair of universal-joint drive connectors 185, drives the drive pulleys 187 and 188 for the far-side "short" loaf feed conveyors 164 and 166; see FIG. 3. Motor 175 also drives a drive pulley 189 for the gripper drive belt 334 of the food loaf feed on the far side of machine 50 and that thus governs the rate at which loaf 503 enters slicing station 66. The peripheral speeds for the loaf food drive pulleys 187–189 are all the same. The two servo motors 174 and 175 are adjustable in speed, independently of each other. Thus, either motor may have its speed regulated to adjust slice thickness for one loaf independently of the other.

FIG. 6 schematically illustrates the drive connection from servo motor 171 to the head or spindle 148 in slicing station 66, through a belt 190; head 148 rotates counterclockwise as indicated by arrow D. Servo motor 172, on the other hand, rotates knife blade 149 clockwise (arrow E) through a drive connection afforded by two belts 191 having a common pulley 195 centrally located on and axially projecting from head 148. Orbital movement of knife blade 149, which determines the duration of each slicing cycle of the blade, depends upon the rotational speed of servo motor 171. The speed of rotational movement of blade 149 is controlled by motor 172. Each speed, orbital and rotational, can be varied independently of the other. The outer cutting edge of blade 149 passes very close to a shearing edge member 501 through which the two food loaves, indicated by phantom outlines 502 and 503, move in the direction of arrow A. Slices cut from the food loaves fall onto receiving conveyor 130, FIG. 7.

Figure 7:
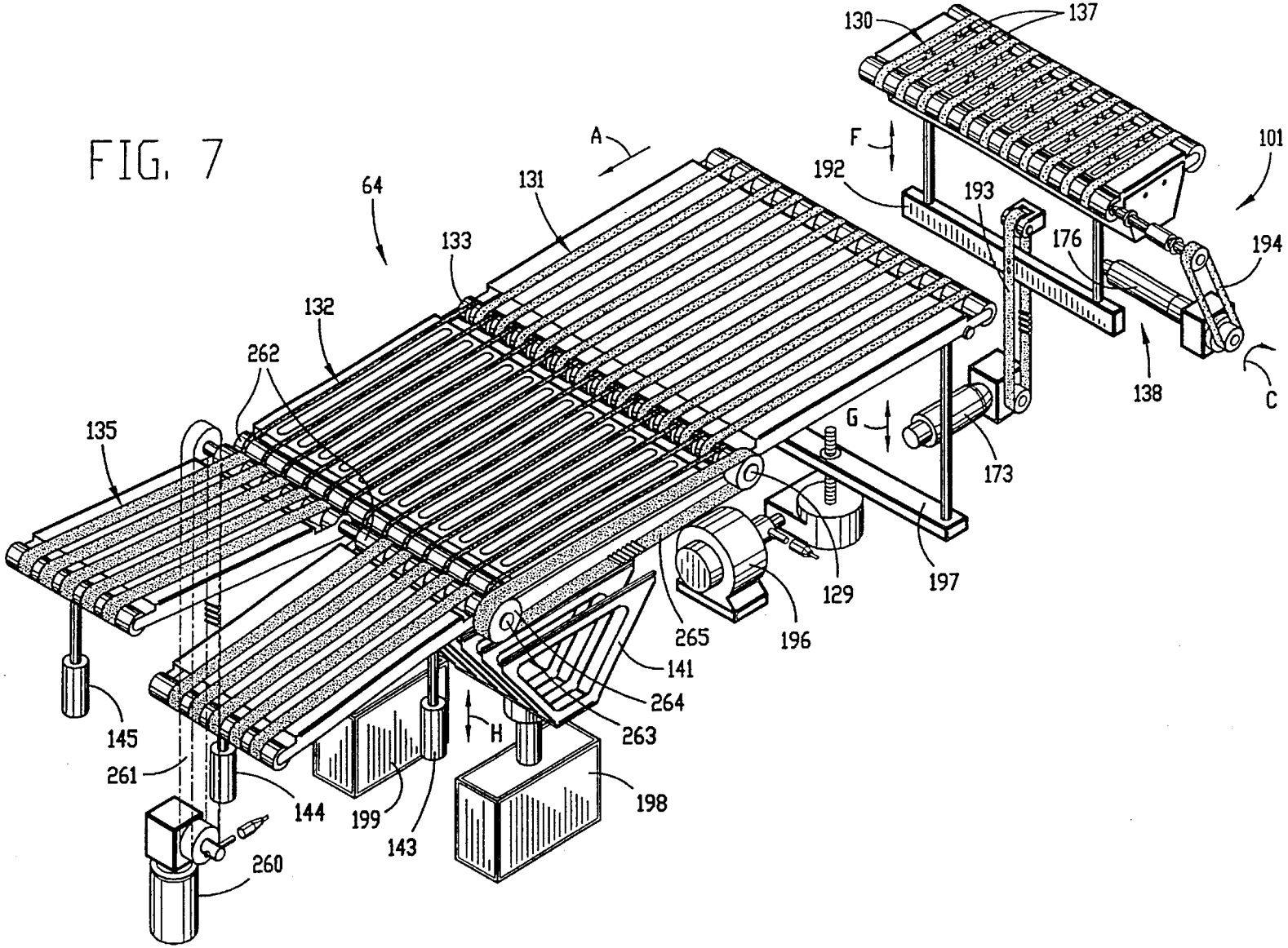
FIG. 7 is a schematic, simplified illustration of the output conveyor/classifier system of the present invention.

The Conveyor/Classifier—FIG. 7.

FIG. 7 shows the manner in which receiver lift motor 173 is connected to receiving conveyor 130 by lift mechanism 138 when there is no receiving grid 136 (see FIG. 3) and food loaf slices are grouped directly on the plural spaced belts of conveyor 130. The drive connection is afforded by connection of a yoke 192 to a timing belt 193 driven by servo motor 173. Thus, motor 173 acts to lift or lower receiver conveyor 130; these actions (arrows F) are carried out cyclically for each group of slices cut from the loaves 502,503 fed into slicing station 66, FIG. 6. Conveyor 130, FIG. 7, also requires a drive motor, shown as the servo motor 176, driving conveyor 130 through a belt 194 in drive 101. During slicing of the loaves motor 176 may rotate slowly in the direction of arrow C (clockwise as seen in FIG. 4B) while motor 173 and mechanism 138 lower conveyor 130 to obtain precise vertical stacks for each group of slices from each loaf. If shingled groups are desired, motor 176 rotates slowly counterclockwise (opposite arrow C) while the loaves are sliced. When the slice groups are complete, motor 176 drives conveyor 130 rapidly counterclockwise for a brief time interval to shift the group of slices, stacked or shingled as the case may be, onto deceleration conveyor 131. While conveyor 130 discharges one or more slice groups onto deceleration conveyor 131, motors 174 and 175 are reversed to keep the food loaves from advancing into slicing station 66 and to avoid production of off-tolerance slices. Thereafter, stacker motor 173 again elevates receiver conveyor 130 rapidly to an elevated position, ready to receive one, two, or more new groups of food loaf slices. A plurality of stacking pin wheels 137 are preferably interleaved in the belts of receiver conveyor 130 and are rotated at the same peripheral speed as the belts of that conveyor.

As shown in FIG. 6, deceleration conveyor 131 and scale conveyor 132 may share a common shaft 129, also seen in FIG. 3; a pulley 133 is mounted on shaft 129. Shaft 129 and pulley 133 are at a fixed height in the machine. The end of conveyor 131 opposite pulley 133 is adjustable upwardly and downwardly to the level necessary to receive groups of food loaf slices from conveyor 130; see arrows G in FIG. 6. The vertical movements of conveyor 131 are provided by mounting the inner end of conveyor 131 on a yoke 197 that is moved upwardly or downwardly by a motor 196. Motor 196 may comprise a pneumatic device, but a hydraulic device or an electrical motor could be used.

The outer (left-hand) end of scale conveyor 132 is dropped a short distance and then subsequently elevated to the position illustrated in FIG. 6 each time a group of food loaf slices (usually two groups side-by-side) traverses the scale conveyor; see arrows H. This vertical movement of the outer end of conveyor 132 is effected by the scale lift mechanism 143. A pneumatic cylinder is preferred for lift 143; a hydraulic cylinder or an electrical linear motor could be used. When conveyor 132 moves down, any group (or groups) of food loaf slices on conveyor 132 is deposited momentarily on one of the scale grids 141 and 142 and weighed (grids 142 are not shown in FIG. 6). Mechanism 143 promptly moves scale conveyor 132 back up to again carry the slice group (or groups) onward to transfer conveyors 134 and 135. Each group of food loaf slices that has a net weight within a desired preset tolerance range is discharged with its classifier/transfer conveyor held down in the "accept" position shown for transfer conveyor 134 in FIG. 6. The range may be different for slice groups on the near and far sides of scale conveyor 132. Each group of slices that does not come within the selected weight range is diverted upwardly by its classifier conveyor, held elevated in the "reject" position shown for conveyor 135 in FIG. 6. Vertical movements of the outer ends of classifier conveyors 134 and 135 are effected by linear lift mechanisms 144 and 145 for conveyors 134 and 135, respectively. Pneumatic cylinders are preferred for devices 144 and 145, but other mechanisms could be employed.

Each time scale conveyor 132 is moved downwardly (arrows H) by lift mechanism 143, so that a group of food loaf slices on the scale conveyor is deposited on scale grid 141 on the near side of the slicing machine, a load cell 198 weights that group of slices, It is this weighing operation that determines whether the classifier conveyor 134 is maintained in the lower "accept" position shown in FIG. 6 or is moved up to the "reject" position shown for conveyor 135. A load cell 199 performs the same basic gross weighing operation for each group of food loaf slices on the far side of the machine. Thus, weight signals from load cells 198 and 199 are used to actuate cylinders 144 and 145 to elevate conveyors 134 and 135, respectively, to their "reject" alignments when food loaf slice groups are not within the preset weight ranges established for the loaves being sliced. Conversely, if a slice group weight is within the weight tolerance range, when weighed by one of the load cells 198 and 199, the applicable load cell signal is used to actuate the associated cylinder 144 or 145 to move the related classifier conveyor 134 or 135 down to its "accept" position or to maintain that classifier conveyor down in the "in tolerance" position.

To get accurate weights for the food loaf slice groups cut by slicing machine 50, the weights of the weighing grids 141 and 142 should be electronically eliminated. The two weighing grids may have slightly different weights to begin with. Moreover, a scrap of food loaf material may cling to one grid and change its weight without a similar change in the other. This difficulty may be eliminated by taking the grid weight from load cells 189 and 199 in each machine cycle when the scale conveyor is elevated and then subtracting these "zero" or "tare" weights from food loaf slice group weight measurements made later in the same machine cycle.

Conveyors 131 and 132, and conveyors 134 and 135 preferably are driven at successively lower speeds, in the direction of arrow A, FIG. 6. That is, conveyor 132 runs slightly slower than conveyor 131, but a bit faster than conveyors 134 and 135. A conveyor drive motor 260 is connected to a timing belt 261 that drives a spindle/pulley 262 serving both classifier conveyors 134 and 135. The drive spindle pulley 262 is mounted on a shaft 263; the end of shaft 263 opposite belt 261 carries a drive pulley 264 in mesh with a timing belt 265 used to rotate shaft 129 and the spindle 133 that drives both of the conveyors 131 and 132.

We claim:

1. An improved high speed food loaf slicing machine comprising:

a slicing station including a knife blade and a knife blade drive cyclically driving the knife blade along a predetermined cutting path;

loaf support means supporting a first food loaf and a second food loaf for movement along first and second loaf paths, respectively, into the slicing station for repetitive slicing of both loaves by the knife blade;

a receiver, including a receiver conveyor having a plurality of spaced receiver conveyor belts, located below the slicing station to receive food loaf slices cut from the first and second food loaves, respectively, to form a first food loaf slice group and a second food loaf slice group;

a receiver lift mechanism connected to the receiver for moving the receiver vertically toward and away from the slicing station;

a receiver conveyor drive for driving the receiver conveyor horizontally at a predetermined discharge speed to discharge food loaf slice groups from the receiver;

a deceleration conveyor for receiving food loaf slice groups from the receiver;

a deceleration conveyor drive for driving the deceleration conveyor at a predetermined speed lower than the discharge speed;

a scale conveyor, including a plurality of spaced scale conveyor belts, movable between a normal elevated position, aligned with the deceleration conveyor to receive food loaf slice groups from the deceleration conveyor, and a depressed weighing position;

a scale conveyor drive driving the scale conveyor belts horizontally;

a scale conveyor lift mechanism for moving the scale conveyor between its normal elevated position and its depressed weighing positions; and a first weighing grid, including a plurality of first grid members aligned with spaces between the scale conveyor belts, the top of the first weighing grid being below the scale conveyor belts when the scale conveyor is in its normal elevated position and above the scale conveyor belts when the scale conveyor is in its depressed weighing position.

2. An improved high speed food loaf slicing machine according to claim 1 in which:

the receiver includes a receiver grid comprising a plurality of grid members aligned with spaces between the receiver conveyor belts, the food slices cut from the first and second food loaves being received on the receiver grid; and in which the receiver lift mechanism is connected to the receiver grid for moving the receiver grid vertically.

3. An improved high speed food loaf slicing machine according to claim 2 in which the improvement further comprises a receiver weighing mechanism connected to the receiver grid for weighing the food loaf slices on the receiver grid.

4. An improved high speed food loaf slicing machine according to claim 1 in which the deceleration conveyor drive and the scale conveyor drive are a single drive mechanism driving both the deceleration conveyor and the scale conveyor horizontally at the same speed.

5. An improved high speed food loaf slicing machine according to claim 1 in which the improvement further comprises:

a second weighing grid, including a plurality of second grid members, the top of the second weighing grid being aligned with the top of the first weighing grid and the second grid members being aligned with spaces between the scale conveyor belts different from the inter-belt spaces in the scale conveyor with which the first grid members are aligned, so that when the scale conveyor is in its depressed weighing position a group of slices from the first food loaf is deposited on the first weighing grid and a group of slices from the second food loaf is deposited on the second weighing grid;

a first weighing mechanism connected to the first weighing grid to generate a first weight signal representative of the weight of a first group of food loaf slices; and a second weighing mechanism connected to the second weighing grid to generate a second weight signal representative of the weight of a second group of food loaf slices.

6. An improved high speed food loaf slicing machine according to claim 5 in which the receiver conveyor, the deceleration conveyor, and the scale conveyor are each wide enough to transport first and second food loaf slice groups in side-by-side alignment, and in which the first and second weighing grids are positioned in alignment with opposite sides of the scale conveyor to weight first and second groups of food loaf slices, respectively, the improvement further comprising:

a first transfer conveyor, aligned with one side of the scale conveyor, for receiving first food loaf slice groups from the scale conveyor; and a second transfer conveyor, aligned with the other side of the scale conveyor in side-by-side relation to the first transfer conveyor, for receiving second food loaf slice groups from the scale conveyor.

7. An improved high speed food loaf slicing machine according to claim 6 in which the improvement further comprises:

a first transfer conveyor lift mechanism, responsive to the first weight signal, connected to the first transfer conveyor for moving the first transfer conveyor vertically between an accept position and a reject position;

a second transfer conveyor lift mechanism, responsive to the second weight signal, connected to the second transfer conveyor for moving the second transfer conveyor between an accept position and a reject position.

8. An improved high speed food loaf slicing machine comprising:

a slicing station including a knife blade and a knife blade drive cyclically driving the knife blade along a predetermined cutting path;

loaf support means supporting a first food loaf and a second food loaf for movement along first and second loaf paths, respectively, into the slicing station for repetitive slicing of both loaves by the knife blade;

a receiver, including a receiver conveyor having a plurality of spaced receiver conveyor belts, located below the slicing station to receive food loaf slices cut from the first and second food loaves, respectively, to form a first food loaf slice group and a second food loaf slice group, the food loaf slices cut by the knife blade being collected on the belts of the receiver conveyor;

a receiver lift mechanism, connected to the receiver conveyor, for moving the receiver conveyor vertically toward and away from the slicing station;

a receiver conveyor drive for driving the receiver conveyor horizontally at a predetermined discharge speed to discharge food loaf slice groups from the receiver;

a deceleration conveyor for receiving food loaf slice groups from the receiver; and a deceleration conveyor drive for driving the deceleration conveyor at predetermined speed lower than the discharge speed.

9. An improved high speed food loaf slicing machine according to claim 8 in which the improvement further comprises:

a deceleration conveyor lift mechanism for adjusting the deceleration conveyor vertically to maintain the deceleration conveyor in alignment with the receiver conveyor to receive groups of food loaf slices from the receiver conveyor.

* * * * *